United States Patent [19]

Chen

[11] 4,163,441

[45] Aug. 7, 1979

[54] SYSTEM FOR RECLAIMING HEAT IN A FURNACE ARRANGEMENT

[76] Inventor: Tung C. Chen, 138 Wooded La., Villanova, Pa. 19085

[21] Appl. No.: 893,285

[22] Filed: Apr. 5, 1978

[51] Int. Cl.[2] ..... F24H 3/00; F24H 3/02; F24B 7/00

[52] U.S. Cl. ..... 126/116 A; 126/110 C; 126/110 E; 126/116 R; 237/55; 165/39

[58] Field of Search ..... 126/110 C, 110 E, 111, 126/116 A, 116 R; 237/55; 165/39

[56] References Cited

U.S. PATENT DOCUMENTS

| | | | |
|---|---|---|---|
| 897,732 | 9/1908 | Gerdes | 126/116 R |
| 2,596,290 | 5/1952 | Ryder et al. | 126/116 A X |
| 2,602,441 | 7/1952 | Hollingsworth et al. | 237/55 X |
| 2,884,196 | 4/1959 | Allen | 126/116 A |
| 3,935,855 | 2/1976 | Van Vliet | 126/116 A X |
| 4,079,885 | 3/1978 | Decker | 237/55 X |

*Primary Examiner*—Samuel Scott

*Assistant Examiner*—Randall L. Green

*Attorney, Agent, or Firm*—William E. Cleaver

[57] ABSTRACT

The present device provides an air duct means disposed between the top end of the heat exchanger of a furnace and the entry port into the flue pipe of the furnace. An electrical blower means is coupled to said duct means to draw hot air therethrough which would otherwise go out to the atmosphere through the flue. The hot air drawn by the blower is redirected to heat, or assist in heating, the building to which the furnace is directing heat, or heat some other facility. An electrical control circuit is connected to the blower means and controls the blower means such that if the furnace is burning fuel, the blower cannot be turned on. The blower can only be turned on after a predetermined time has elapsed from the time that the fuel burning has terminated, so that combustion gases which otherwise would pass through the flue and which might contain harmful ingredients therein, will not be redirected to be used as a source of heat.

5 Claims, 2 Drawing Figures

SYSTEM FOR RECLAIMING HEAT IN A FURNACE ARRANGEMENT

BACKGROUND

It is a well known fact that in the operation of a furnace, using any ordinary fuel, the heat loss through the flue is considerable. There have been a number of concepts conceived to reduce these heat losses. Many of these concepts in one way or another rely on closing a damper in the flue after the fuel stops burning and the gases of combustion have been exhausted thereby trapping replacement air around the heat exchanger so that air, steam or hot water passing through the heat exchanger will continue to be heated or extract heat from the trapped hot replacement air. Some other concepts have employed heat exchangers in the flue stack so that heat can be extracted from the flue gases even when the fuel is burning. In at least one system in the prior art there is provided a valve controlled opening, out of the preflue chamber, so that when on fuel is being supplied for burning, the hot replacement air from a previous period of burning will be permitted to pass into the furnace room to heat the same.

The present system does not rely on closing the flue stack by a damper or using a heat exchanger in the flue, both of which arrangements are costly and in the case of closing the damper there is some danger involved if the damper jams or sticks as will be explained later. The present system forceably intercepts hot air which otherwise would pass through the flue and redirects that hot air, only during a safe period, into the overall heating arrangement.

SUMMARY

In the present reclaiming apparatus there is provided an air duct means whose entry port is located between the heat exchanger of a furnace and the entry port of the furnace flue. When the fuel which provides heat in the furnace is burning, the hot gases developed in response to the burning fuel may often include toxic or poisonous gases. However, after a period of time, marked from when the fuel burning terminates, the poisonous gases have passed up the flue and replacement air from the basement is drawn into the chamber surrounding the heat exchanger. This replacement air warms up and it too would ordinarily pass through the flue due to the draft. In the present system this heated replacement air is intercepted by providing a suction action in the port of an air duct located between the heat exchanger and the port of the flue. This warmed air which would otherwise be jettioned into the atmosphere is redirected by the blower to provide heat to the facility being heated or to a different facility for heating.

The features and objects of the present invention will be better understood in view of the following description taken in conjunction with the drawing wherein.

Figure 1:
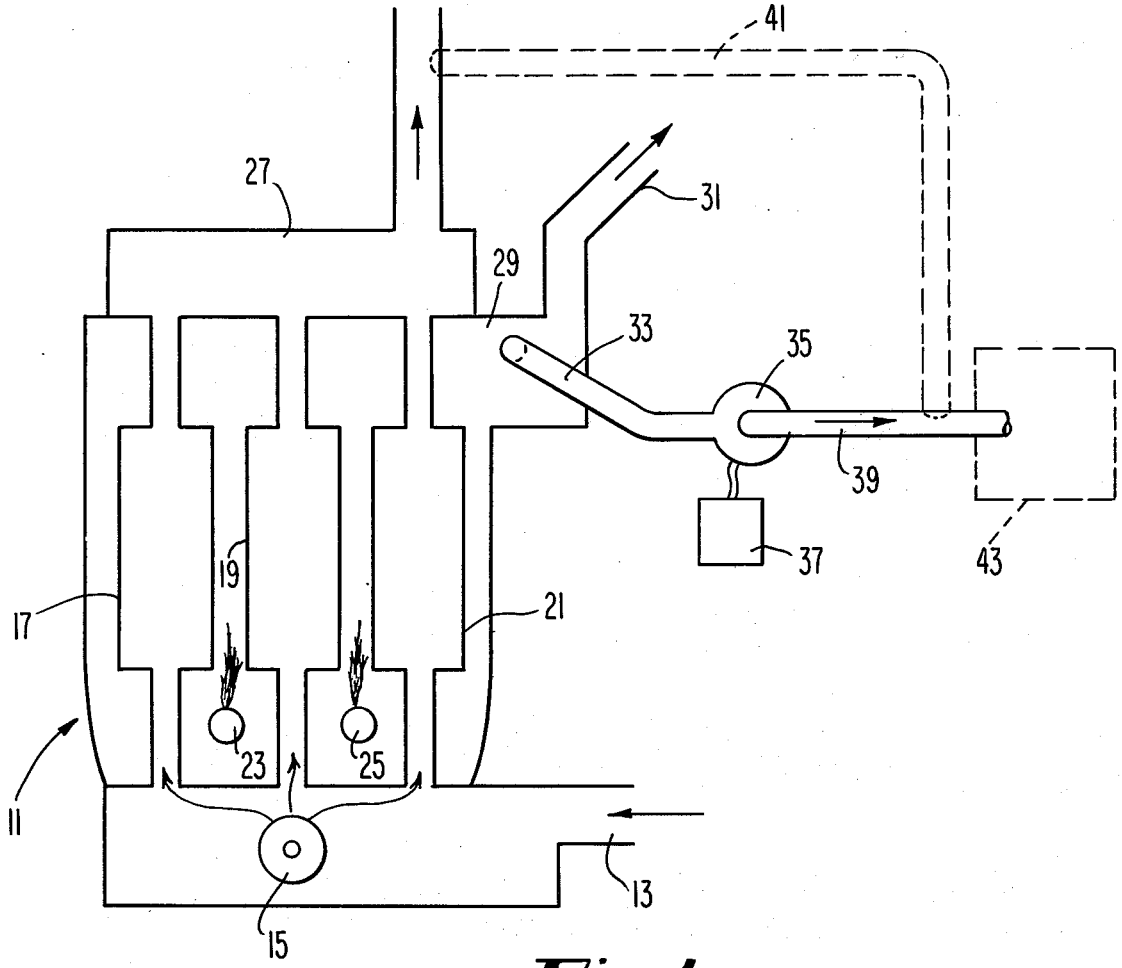
FIG. 1 is a schematic layout of a furnace with the heat reclaiming feature.

Consider FIG. 1 wherein there is depicted a furnace arrangement 11. The present invention will be described with a gas heat-hot air heating system, but it should be understood that the present invention can be employed with other fuel systems such as oil or coal and with other heating systems which use a heat exchanger in the furnace. In FIG. 1, the structure depicted has a cold air return duct port 113. After hot air has been directed into the facility to be heated, such as a house, as will be described infra, the air cools off to some extent and is withdrawn by a main blower 15. When the main blower 15 is running it sucks air through the return duct ports, or registers, in each room and this recirculated air passes through the return duct port 13.

Not only does the main blower 15 suck cooled air from the facility but forces the air after it is heated by the heat exchanger through hot air ducts into the facility to heat it. In FIG. 1 the main blower 15 blows the returning cold air through the heat exchanger chambers 17, 19 and 21. The heat exchanger chambers are usually made of steel which is a good heat conducting metal.

Located in close proximity to the heat exchanger chambers, as shown in FIG. 1, are fuel burning means 23 and 25. The fuel burning means can be a fuel gun, or fuel jet, disposed to pass fuel in close proximity to a glow lamp or ignition source. The flames from the burning fuel heat up the heat exchanger chambers 17, 19 and 21. When the returning cold air is forced through the heat exchanger chambers 17, 19 and 21, the air is heated and thereafter is passed to the hot air duct system. Hot air in the hot air duct system is forced therethrough, and through hot air registers into the facility (rooms in a house) to render that facility warm.

As can be seen in FIG. 1, the hot gases generated by burning the fuel do not pass into the hot air duct system but instead make their way through the preflue chamber 29 and on out through the flue 31. The hot gases initially contain harmful gases such as carbon monoxide (CO) and accordingly it is desirable to pass the combustion gases which are produced by burning fuel through the flue 31.

However, as can be readily understood a great deal of heat is lost through the flue and it is to the reclamation, or loss prevention, of some of that heat that this invention is directed.

As the facility becomes heated its temperature will rise and a thermostat will become open when the proper temperature is attained. When the thermostat opens the fuel is cut off and the flame is stopped. Accordingly, no further gases with products of combustion are generated. It has been determined that since the flue gases have temperatures higher than 400° F., there is a strong draft maintained which continues to draw gases from the furnace chamber surrounding the heat exchanger. These gases are replaced by air (normally the oxygen charge) from the basement area around the furnace. Bear in mind that the heat exchanger remains hot so that this new air soon becomes hot. This new heated replacement air would be carried up with the previously mentioned draft if it were not for the intervention of the present invention. It is the heat of this new air that is reclaimed or prevented from being lost.

In FIG. 1 when the new air is pulled toward the flue 31, it is sucked through the by-pass duct 33 because of the pumping or sucking action of the auxiliary blower 35. The auxiliary blower 35 is controlled by the control circuitry 37, the details of which are shown in FIG. 2.

Figure 2:
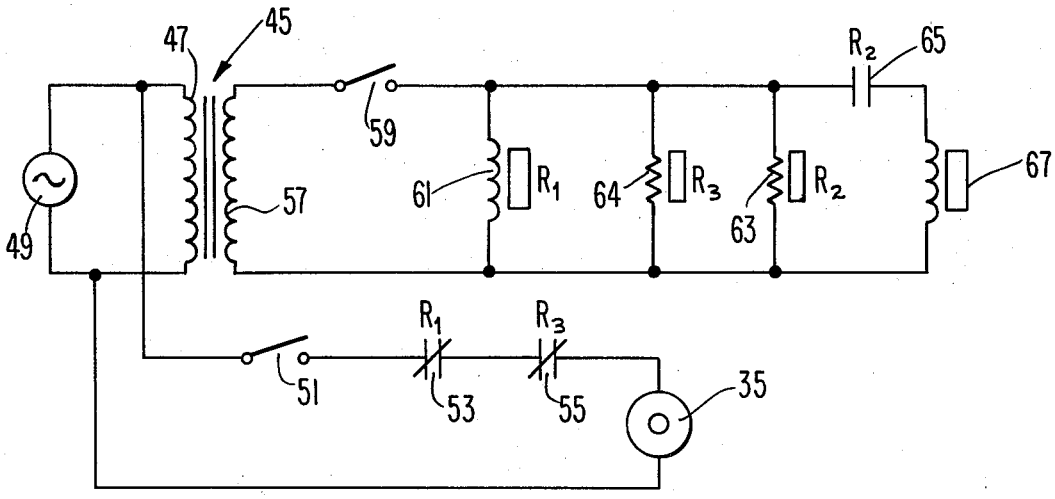
FIG. 2 is a circuit schematic of the control circuit used to control the blower of the heat reclaiming feature.

As will be better understood from the description of FIG. 2, the auxiliary blower 35 will not be turned on until a predetermined time has elapsed after the fuel has stopped burning. The delay is to insure that the gases, with products of combustion therein, have passed through the flue and only the heated replacement air is by-passed through by-pass duct 33. The hot air which is pumped through the by-pass duct 33 is pushed beyond the auxiliary blower 35 through the reentry duct back into the facility or to another facility to be heated. As shown in phantom in FIG. 1, the hot air can be pumped or driven through the pass-on duct 41 back into the hot air duct system. In an alternative, the hot air can be driven into another facility 43.

Consider FIG. 2 which depicts in detail the control circuitry 37. In FIG. 2 there is shown a transformer 45, the primary 47 of which is connected to an alternating current source 49. Connected across the A.C. source 49 is a circuit including thermostat 51, normally closed relay points 53, normally closed relay points 55 and auxiliary blower 35. The thermostat 51 is located in the heat exchanger and in the preferred embodiment closes when the temperature in the heat exchanger exceeds 80° F.

Connected to the secondary 57 of the transformer 45 is a circuit which includes a thermostat 59, (which is located in facility or room to be heated), an electromagnetic relay 61 (connected across the secondary 57), two thermostatic delay relays 63 and 64 (also connected across the secondary 57), normally open relay points 65, and a solenoid operated fuel valve 67.

In operation the termostat 59 opens when the facility or room is heated to the desired temperature. Assume for the moment that the room temperature has fallen below the desired temperature and therefore there is a need for heat. Thermostat 59 would close and relays 61, 64 and 63 are energized. The thermostatic delay relays 63 and 64 must be heated for a predetermined period before they will be activated to respectively close the normally open points 65 and open points 55. Hence, the solenoid fuel valve 67 will not be activated until the delay relay 63 is activated, which is after some predetermined delay.

When the delay relay 63 becomes activated the normally open points 65 close and the solenoid operated valve 67 opens to permit fuel into the system to be burned. Now when delay relay 64 is activated (which is at the same time as relay 66) the normally closed relay points 55 become opened so that irresective of the condition of other components it is apparent that if fuel is permitted into the chamber to be burned, the auxiliary blower will not be turned on. Relay points 65 and 55 could be part of a single relay in which case only one of the relays 63 or 64 would be necessary.

If we examine the other components, we find that relay 61 was activated as soon as the thermostat 59 closed and accordingly, the normally closed relay points 53 are also open, also preventing the activation of the auxiliary blower 35 at this time. Having the two relay points in the auxiliary blower circuit insures that if the desired room temperature is attained and the fuel valve is accordingly turned off, the auxiliary blower will not pump any air or gases until a predetermined time has elapsed to permit the harmful gases to pass up through the flue. That predetermined time is the delay in deactivating the relay 64. In the preferred embodiment it takes thirty seconds from the time that thermostat 59 opens until relays 63 and 64 drop out or are deactivated. However, note that when the desired temperature has been attained thermostat 59 opens and the solenoid operated fuel valve drops out thereby shutting off the fuel supply even though relay points 65 are closed.

When thermostat 59 opens relay 61 drops out thereby permitting relay points 53 to close. Since heating has taken place to cause thermostat 59 to open, we can assume that the temperature of the heat exchanger has exceeded 80° F. and hence thermostat 51 is closed. Accordingly, when the predetermined time passes and relay 64 deactivates, relay points 55 will close and auxiliary blower 35 will be turned on to pump the heated air from the heat exchanger.

It is important that the auxiliary blower 35 not be run when the furnace is burning fuel as explained earlier. The circuit of FIG. 2 assures this safety factor. If we assume that the auxiliary blower is operative and the facility demands more heat, then the thermostat 59 will close while the auxiliary blower 35 is pumping air. However, note that as soon as thermostat 59 closes, the relay 61 is energized to open normally closed relay points 53 which would cause the auxiliary blower to stop. Nonetheless, the fuel would not be burning in that brief period of time when the thermostat 59 closed before the opening of relay points 53 terminated the operation of blower 35 because the activation of relay 63 is delayed.

The fail safe advantage of the present system over the the prior art should be noted. In a system which closes a damper, if it fails, the damper sticks and the harmful combustion gases are trapped in the facility. In the present system, if it fails, the auxiliary blower doesn't operate but the flue stays open and the harmful combustion gases are not trapped in the facility.

While the present invention has been taught with a gas heat-hot air system other heating systems could be emloyed. For instance, if the system were an oil heat-hot water, the hot air from duct 39 would be directed to the chamber where the water is heated and the solenoid valve 67 would control the oil burner and ignition system. As an alternative in this last described system, hot air could be directly added in a room to the air therein which had been heated by the hot water.

In the preferred embodiment the auxiliary blower 35 is a Model 4C443 manufactured by Dayton Electric Manufacturing Co.; and the delay relays 63 and 64 are Models 26NO30T and 26C30 manufactured by Amperite Company.

What I claim is:

1. A system to reclaim heat to be employed with a furnace which has a heat exchanger and a flue means with an entry port comprising in combination: a by-pass duct means formed to be fitted into said furnace between said heat exchanger and said entry port to be able to intercept hot air passing from said heat exchanger to said flue; blower means to create a suction phenomenon in said by-pass duct means; pass-on duct means coupled to said blower means to direct hot air sucked through said by-pass duct to some facility to be heated; and control circuitry means connected to said blower means to insure that said blower means will not cause a suction phenomenon until some predetermined time after said furnace has stopped burning fuel.

2. A system to reclaim heat according to claim 1 wherein said furnace has a heat directing means and wherein said pass-on duct means is connected into said heat directing means.

3. A system to reclaim heat according to claim 1 wherein said furnace has a heat directing means to heat a facility and wherein said pass-on duct means is connected to heat another facility.

4. A system to reclaim heat according to claim 1 wherein said control circuitry means includes a circuit connected to the blower through at least one set of relay points and through thermostat points of a thermostat located in proximity to said heat exchanger and wherein there is a relay to control said one set of relay points and it is connected in a circuit to control fuel to the furnace whereby if fuel is being fed to the furnace said relay will act to have said set of relay points open so that said blower cannot operate.

5. A system to reclaim heat according to claim 1 wherein said control circuitry means includes a series circuit connected through a thermostat located in closed proximity to said heat exchanger, through first and second normally closed relay points to said blower and wherein said control circuitry means further includes a series circuit connected through a facility thermostat and through a pair of normally open relay points to an electrically controlled fuel regulator means and wherein there are at least first and second relay means connected across said electrically controlled fuel regulator means and said normally open relay points and wherein said second relay means is a thermostatic delay relay having a delay time for being activated and a delay time for being deactivated and wherein said normally open relay points and said second normally closed relay points are controlled by said thermostatic delay relay means so that if said facility thermostat is closed to energize said delay relay means said fuel regulator cannot be activated for a predetermined time and if said heat exchanger thermostat is closed, said blower cannot be turned on until some predetermined time after said delay relay has been deenergized by opening siad facility thermostat.

* * * * *